US011105064B2

(12) United States Patent
Smith

(10) Patent No.: US 11,105,064 B2
(45) Date of Patent: Aug. 31, 2021

(54) SWIVELABLE ADAPTER DEVICE FOR A SKID STEER LOADER HAVING A PIN LOCKING MECHANISM

(71) Applicant: Wayne J. Smith, Brookhaven, MS (US)

(72) Inventor: Wayne J. Smith, Brookhaven, MS (US)

( * ) Notice: Subject to any disclaimer, the term of this patent is extended or adjusted under 35 U.S.C. 154(b) by 0 days.

(21) Appl. No.: 16/688,432

(22) Filed: Nov. 19, 2019

(65) Prior Publication Data

US 2020/0087885 A1 Mar. 19, 2020

Related U.S. Application Data

(63) Continuation-in-part of application No. 15/230,706, filed on Aug. 8, 2016, now Pat. No. 10,480,152.

(60) Provisional application No. 62/387,835, filed on Jan. 7, 2016.

(51) Int. Cl.
*E02F 3/36* (2006.01)

(52) U.S. Cl.
CPC ..... *E02F 3/3681* (2013.01)

(58) Field of Classification Search
CPC ..... B66F 9/125; E02F 3/3609; E02F 3/3622; E02F 3/3672; E02F 3/3677; E02F 3/3681; E02F 3/3686
USPC ..... 37/468; 172/825; 414/686, 723
See application file for complete search history.

(56) References Cited

U.S. PATENT DOCUMENTS

| | | | | | |
|---|---|---|---|---|---|
| 2,281,004 | A * | 4/1942 | Lehmann | B66F 9/18 | 414/641 |
| 3,941,262 | A | 3/1976 | Moser | | |
| 5,098,252 | A | 3/1992 | Sheesley | | |
| 5,114,299 | A | 5/1992 | Roche | | |
| 5,121,557 | A * | 6/1992 | Moore | E02F 3/3677 | 37/406 |
| 5,257,890 | A * | 11/1993 | Vickary | B66F 9/02 | 414/420 |
| 5,393,190 | A * | 2/1995 | Vickary | B65G 65/23 | 187/226 |
| 5,562,398 | A | 10/1996 | Knutson | | |
| 5,575,093 | A * | 11/1996 | Pratt | E02F 3/3618 | 37/468 |
| 5,938,399 | A * | 8/1999 | Knutson | E02F 3/3609 | 414/722 |

(Continued)

*Primary Examiner* — Saul Rodriguez
*Assistant Examiner* — Brendan P Tighe
(74) *Attorney, Agent, or Firm* — Laurence P. Colton; Smith Tempel Blaha LLC

(57) ABSTRACT

A swivelable adapter device used with skid steer loaders includes a mounting plate and a swiveling work tool plate for holding, rotating, and positioning skid steer attachments. Rotation about a longitudinal axis of skid steer arms is accomplished using a barrel within a barrel assembly allowing the work tool plate to be positioned from angles between horizontal and vertical. A mounting plate is attached to skid steer arms and is rigidly affixed to an inner barrel. An outer barrel with a notch plate and a work tool plate slides over a greased inner barrel. Swivel operation of the work tool plate is accomplished by hand, eliminating the need for hydraulic systems. Once positioned, the work tool plate is locked to a notch plate using a locking mechanism, such as a locking pin or locking latch. The device is reinforced with metal plates to handle torsion forces created by heavy loads.

19 Claims, 14 Drawing Sheets

(56) References Cited

U.S. PATENT DOCUMENTS

| | | | | |
|---|---|---|---|---|
| 6,360,459 | B1 * | 3/2002 | Brookhart | E02F 3/345 172/825 |
| 10,480,152 | B1 * | 11/2019 | Smith | E02F 3/3686 |
| 2006/0182599 | A1 | 8/2006 | Potter | |
| 2009/0096190 | A1 * | 4/2009 | Sharp | E02F 3/3677 280/727 |
| 2011/0271562 | A1 | 11/2011 | Nesseth | |
| 2018/0216704 | A1 * | 8/2018 | Louden | F16H 1/16 |

* cited by examiner

SWIVELABLE ADAPTER DEVICE FOR A SKID STEER LOADER HAVING A PIN LOCKING MECHANISM

CROSS-REFERENCE TO RELATED APPLICATIONS

This application claims the benefit of and is a continuation-in-part of U.S. patent application Ser. No. 15/230,706 having a filing date of 8 Aug. 2016, which claims the benefit of U.S. Provisional Patent Application No. 62/387,835 having a filing date of 7 Jan. 2016.

BACKGROUND OF THE INVENTION

Technical Field

This device relates to a swivelable adapter device for positioning a variety of work attachments to a skid steer loader. More particularly, this swivelable adapter device provides a means to facilitate attachment of a work tool, and then to rotate the tool using a rotatable forward mounting plate which is pivotally disposable so as to permit work tool engagement of a fallen tree resting at an angle. The invention is further adaptable to couple with various industry skid steer loaders and it may accept common skid steer loader attachment tools.

A standard task during tree-trimming cleanup efforts following a major hurricane, for example, is the removal of downed trees. Many times, downed trees are resting precariously on structures and resting at various angles. Tools and devices presently exist to grasp and collect downed trees, but none exists for skid steer loaders that have a manual swivel capability of 90 degrees of rotation. This lack of the capability to grasp a downed tree resting at an angle means possible further damage to a structure.

What is new and unobvious in this present invention is the ability to adapt a work tool to a skid steer loader, attach working implements, then rotate working implements to a range of angles from horizontal to vertical using manual force to rotate, and lock the device in a fixed position.

There is a need for an adapter positioned between a skid steer loader and a work tool attachment that allows addressing of the work tool piece at various angles. Some adapters rotate a few degrees from the typical front mount setting position of horizontal. The instant swivel adapter rotates from a horizontal position to a vertical position. The rotation of the swivel adapter is a full ninety degrees from a horizontal position to a vertical position.

Hydraulic system compatibility of an attachment device is a problem for many skid steer loaders because the hydraulic system connector pin to control attachments may differ among various skid steer models. The hydraulic system compatibility problem is overcome in the instant swivelable adapter device by the elimination of the use of hydraulics to rotate the forward work tool mounting plate. The forward work tool mounting plate can easily be rotated manually by hand.

Prior Art

The use of skid steer loader attachments is known in prior art.

U.S. Pat. No. 5,562,398, entitled Skid Steer Loader Tiltable Attachment, to Knutson teaches that the attachment maintains the ability of the skid steer loader to move utility attachments in the horizontal and vertical planes while providing the ability to rotate the utility attachment around the longitudinal axis of the skid steer loader. However, the rotation of the Knutson '398 patent is limited to a few angles greater than horizontal and cannot rotate a full 90 degrees.

U.S. Pat. No. 5,938,399, entitled Skid Steer Loader Rotatable Attachment, to Knutson teaches the rotational assembly and work attachment are conjointly rotatable through 360 degrees in a plane. However, the Knutson '399 device relies on hydraulic power as a motive force. This is a great disadvantage because of the fact that not all manufacturer's hydraulic attachment systems are common. The Knutson '399 grant is limited to skid steer loaders with compatible hydraulic systems.

U.S. Pat. No. 6,360,459, entitled Tiltable Bucket Assembly, to Brookhart et al., teaches a hydraulic cylinder adapted to provide rotational movement of the bucket. The grant is for a device with a limited angle of rotation. The assembly requires the motive force of hydraulics, further limiting its adaptability to a wide range of skid steer loaders that do not have compatible hydraulic systems.

U.S. Pat. No. 3,941,262, entitled Pivotally Disposable Bucket, to Moser teaches a bracket member pivotable to bring the standard cutting edge into engagement with a work surface. The device is a rotatable attachment but not utilized with a skid steer loader.

U.S. Pat. No. 5,114,299, entitled Attachment for a Prime Mover, to Roche et al., teaches a loading bucket pivotally attached to a support frame by a large pivot pin. The patent is for a device with the singular purpose of grappling. The device does not have the capability to attach any of the various work tools available in the market.

US Patent Application Publication No. 2011/0271562, to Nesseth, describes an implement that is pivotally tiltable relative to the motor vehicle along a plane. However, the device is limited in the range of angles at which the device can be fixed.

US Patent Application Publication No. 2006/0182599, to Potter et al., describes an adapter for mounting on a work machine comprising an attachment for individually attaching one or more working implements to the work machine and allowing lateral rotation or tilting of the working implement. However, the device purports to establish that degree of relative rotation is determined by the length of slots, thereby limiting the range of angles to a few degrees from horizontal.

U.S. Pat. No. 5,098,252, to Sheesley et al., teaches an adapter mechanism for use with a skid steer loader having an implement mounting plate that permits attachment of an implement, However, this device does not rotate. Therefore, any attached work tool cannot rotate.

Historically, U.S. Pat. No. 2,281,004, entitled Industrial Truck, to Lehmann, teaches changing the position of a load carrier prior to depositing the load.

Accordingly, it would be advantageous to provide a swivelable adapter for a skid steer loader to attach work tool implements that allows for rotation about a longitudinal axis of skid steer loader lift arms, and that is inexpensive, easy to operate, compact, and simple in design.

BRIEF SUMMARY OF THE INVENTION

In view of the foregoing disadvantages inherent in the known types of skid steer adapters in the prior art, the swivelable adapter provides a solution to the problem of utilizing skid steer loaders to grasp objects at various angles. The swivelable adapter is a device to connect work tools to the lift arms of a skid steer and then allow the work tool to be manually rotatable to a desired work angle between horizontal and vertical, either in a direction to the left or to the right, requiring no use of hydraulics.

The general purpose of the present invention is to provide a new, improved swivelable adapter device, a method, which is simpler to use and does not need hydraulics to function. The swivelable adapter device is not anticipated, rendered obvious, suggested, or even implied by any prior art skid steer loader attachment devices known to the inventor, that permits an operator to grasp a leaning tree at working angles from horizontal to vertical.

The swivelable adapter device comprises sandwiched metal plates, including a skid steer mounting plate, a notch plate, a swivelable work tool plate, a locking mechanism such as a locking latch or a locking pin, all fitted to a barrel within a barrel assembly.

The swivelable adapter is intended for use by attachment to skid steer loader lift arms and to a work attachment tool forward of the invention.

The instant invention is a device to facilitate attachment of arborist tools to a skid steer loader. The adapter allows a skid steer loader a capability to orient an attached work tool utilizing a barrel within a barrel rotation system, where the work tool plate is rotatable relative to a fixed skid steer mounting plate. The work tool plate is rotatable preferably 180 degrees, 90 degrees in each of two opposite rotational directions, in a plane transverse to a longitudinal axis of the lift arms of a skid steer loader.

To attain this novelty, according to one exemplary embodiment, the swivelable adapter device comprises an aft mounting plate mountable to skid steer lift arms, a rotational assembly with a lockable feature, and a forward mounting tool plate for attachment of a working tool. As such, the forward mounting plate is swivelable through an arc of 90 degrees, either to the left or to the right, using only gravity to assist the rotation about the longitudinal axis of the lift arms of the skid steer loader. The swivelable adapter permits grabbing trees leaning at angles, as in the case of a fallen tree resting on a structure following a storm or hurricane.

There has thus been outlined, broadly, several features of the swivelable adapter device in order that the detailed description thereof that follows may be better understood, and in order that the present improvement of the art may be better appreciated. There are additional features that will be described hereinafter and which form the subject matter of the claims appended.

As such, those skilled in the art will appreciate that the conception, upon which this disclosure is based, may readily be utilized as a basis for the designing of other structures, methods, and systems for carrying out the several objects of the present invention. It is important that the claims be regarded as including such equivalent constructions insofar as they do not depart from the spirit and scope of the swivelable adapter device.

BRIEF DESCRIPTION OF THE DRAWINGS

These and other features, aspects, and advantages of the swivelable adapter device will become better understood with regard to the following description, appended claims, and accompanying drawings. Such description makes reference to the annexed drawings wherein:

DETAILED DESCRIPTION OF PREFERRED EMBODIMENTS

Figure 1:
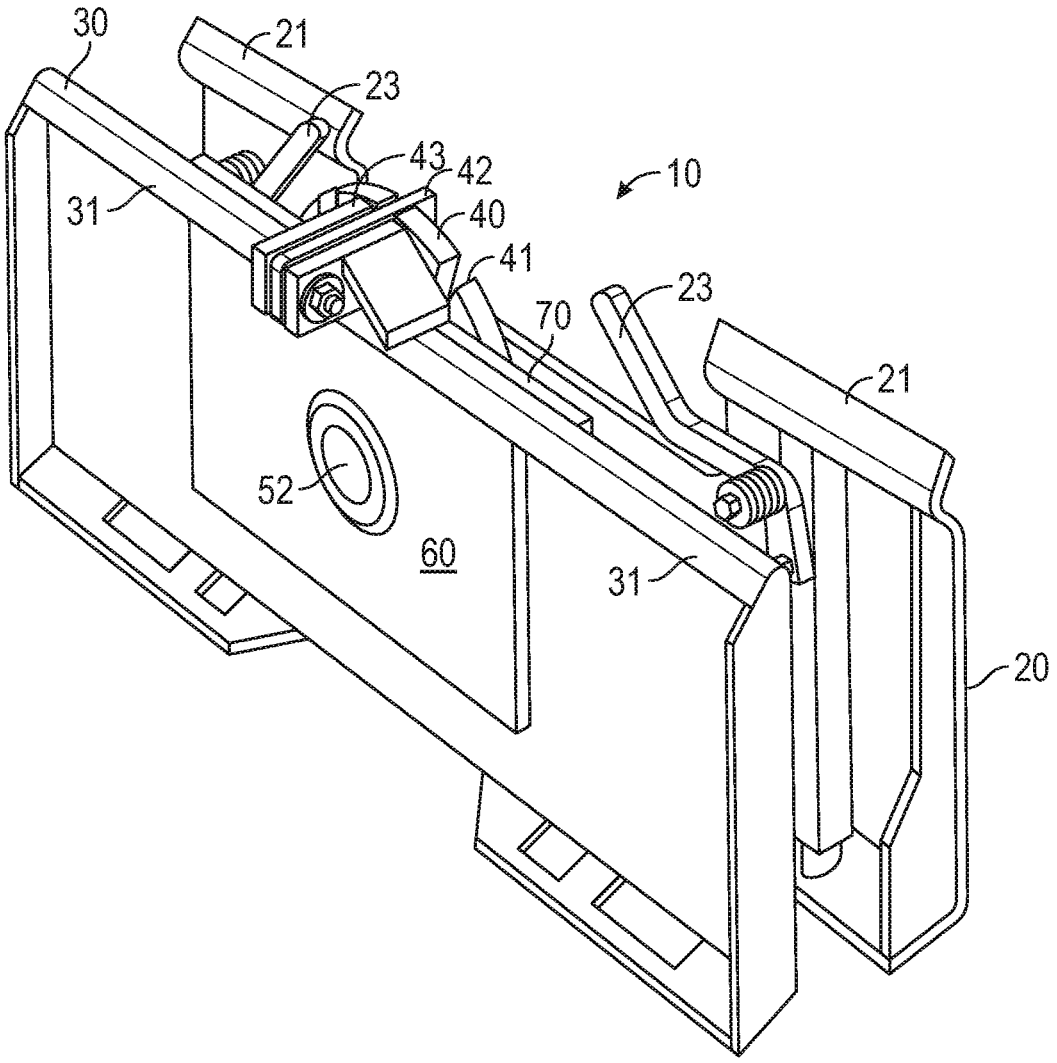
FIG. 1 is a perspective view of a first exemplary embodiment of the swivelable adapter device showing a mounting plate with a locking latch support affixed on a lipped edge of a mounting plate. Further forward from the mounting plate, the locking latch sits in a notch in a notch plate. Further forward still, is a work tool plate and its associated latching handle system.
Figure 2:
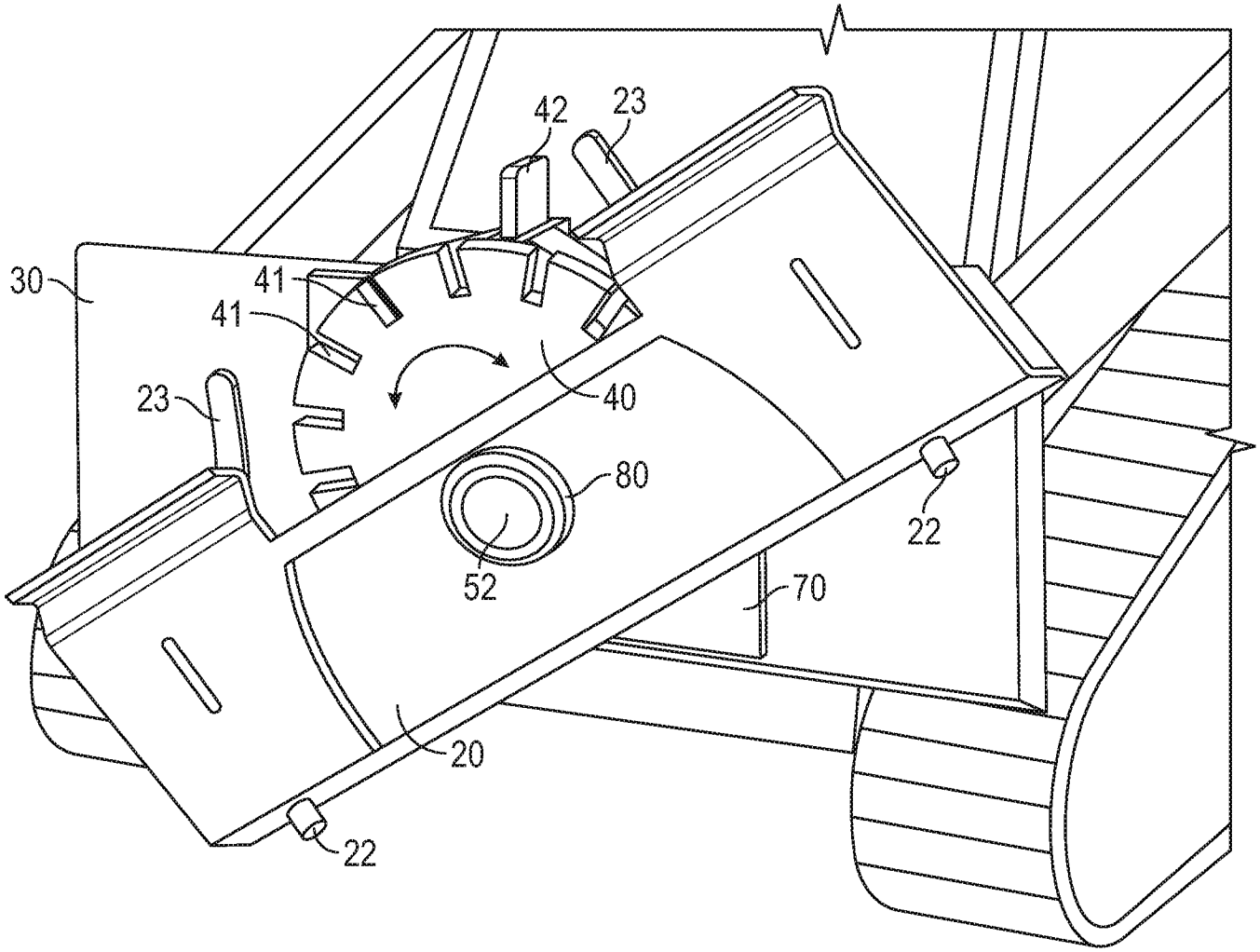
FIG. 2 is a perspective view showing the device mounted on a skid steer loader with the mounting plate positioned at a 45-degree angle with respect to horizontal fixed mounting plate.
Figure 3:
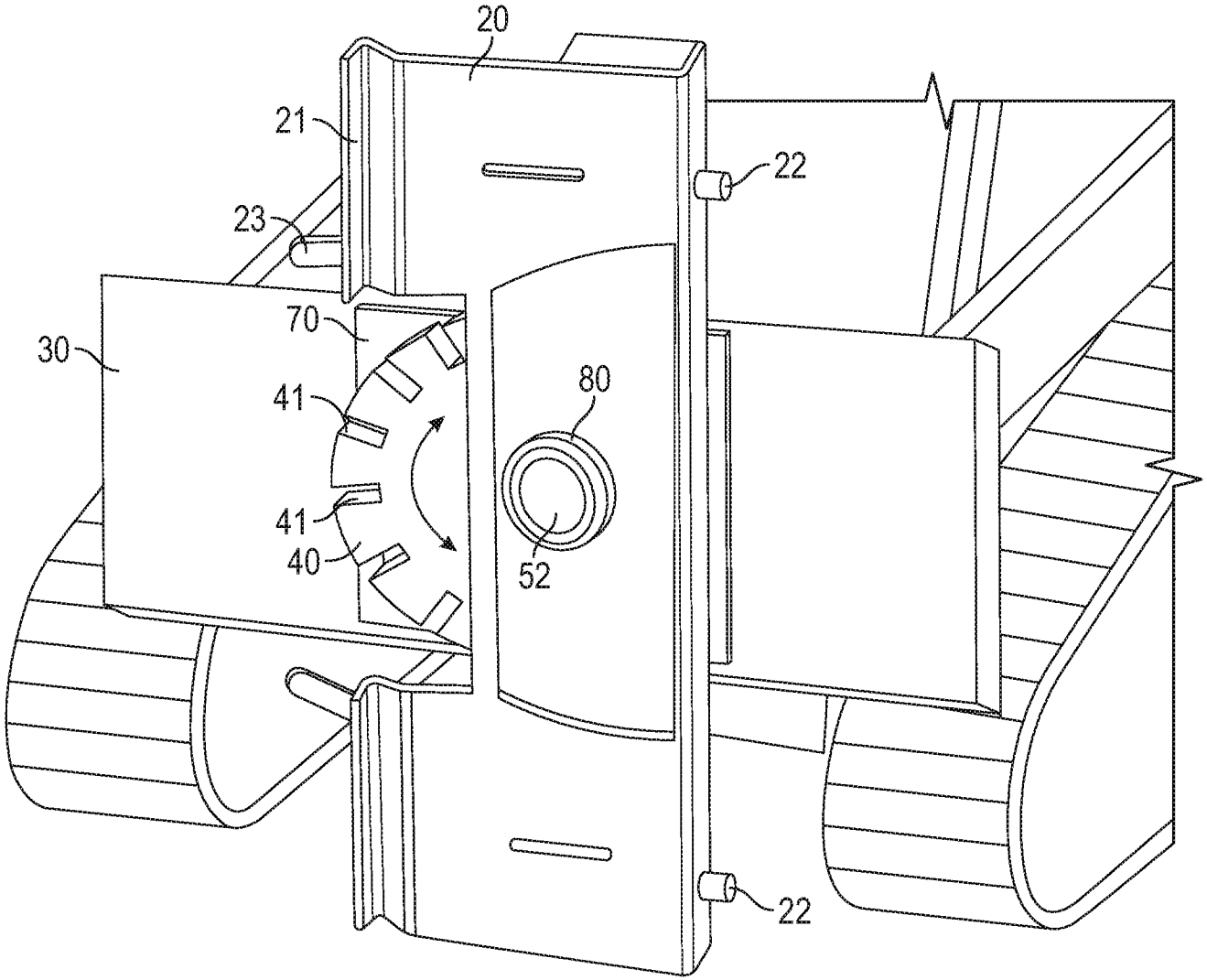
FIG. 3 is a perspective view showing the device mounted on a skid steer loader with the mounting plate positioned at a 90-degree angle with respect to the horizontal fixed mounting plate.

As illustrated in the figures, the swivelable adapter device 10 is intended for use with various industry skid steer loaders to allow adapting work tools to a skid steer loader, and then to allow the work tool to be swiveled to a desired work angle between horizontal and vertical. The present device is an adapter that swivels. The adapter mounts on a skid steer loader, and a work tool then mounts to the adapter.

FIGS. 1-6 illustrate a first exemplary embodiment of a swivelable adapter device 10 having a latch locking mechanism 42 as the illustrative locking mechanism. FIGS. 7-18 illustrate a second exemplary embodiment of a swivelable adapter device 10 having a pin locking mechanism as the illustrative locking mechanism, compared to the latch locking mechanism of FIGS. 1-6. Aside from the alternative exemplary embodiments of the locking mechanism, the swivelable adapter 10 of all of the figures operates in the same general manner. With respect to FIGS. 7-18, parts that are similar to the parts illustrated in FIGS. 1-6 will have a similar reference number designation with three digits instead of two. For example, notch plate 140 of FIGS. 7-18 has three digits while notch plate 40 of FIGS. 1-6 has two digits.

Referring now to FIGS. 1-6, the swivelable adapter device 10 is a series of parallel metal plates rigidly affixed on a set of metal barrels. One set of metal plates is fixed to an inner barrel 52. A second set of plates is affixed to an outer barrel 51. The inner dimension of the outer barrel 51 is greater than the outside dimension of the inner barrel 52 to allow the outer barrel 51 clearance to slide over the inner barrel 52.

The outer barrel 51, with its affixed set of plates, slides over the inner barrel 52 during assembly. The metal plates are a notch plate 40 and a reinforcing work plate 90 (see FIG. 5). The set of metal plates affixed to the inner barrel 52 are an aft reinforcing mounting plate 60 and a forward reinforcing mounting plate 70 (see FIG. 5). The entire swivelable adapter device 10 is held together with a holding ring 80 permanently affixed to a forward end of the inner barrel 52 once the outer barrel 51 is slid onto the inner barrel 52 during the assembly process. Once permanently assembled, the outer barrel 51 rotates around the inner barrel 51.

Figure 5:
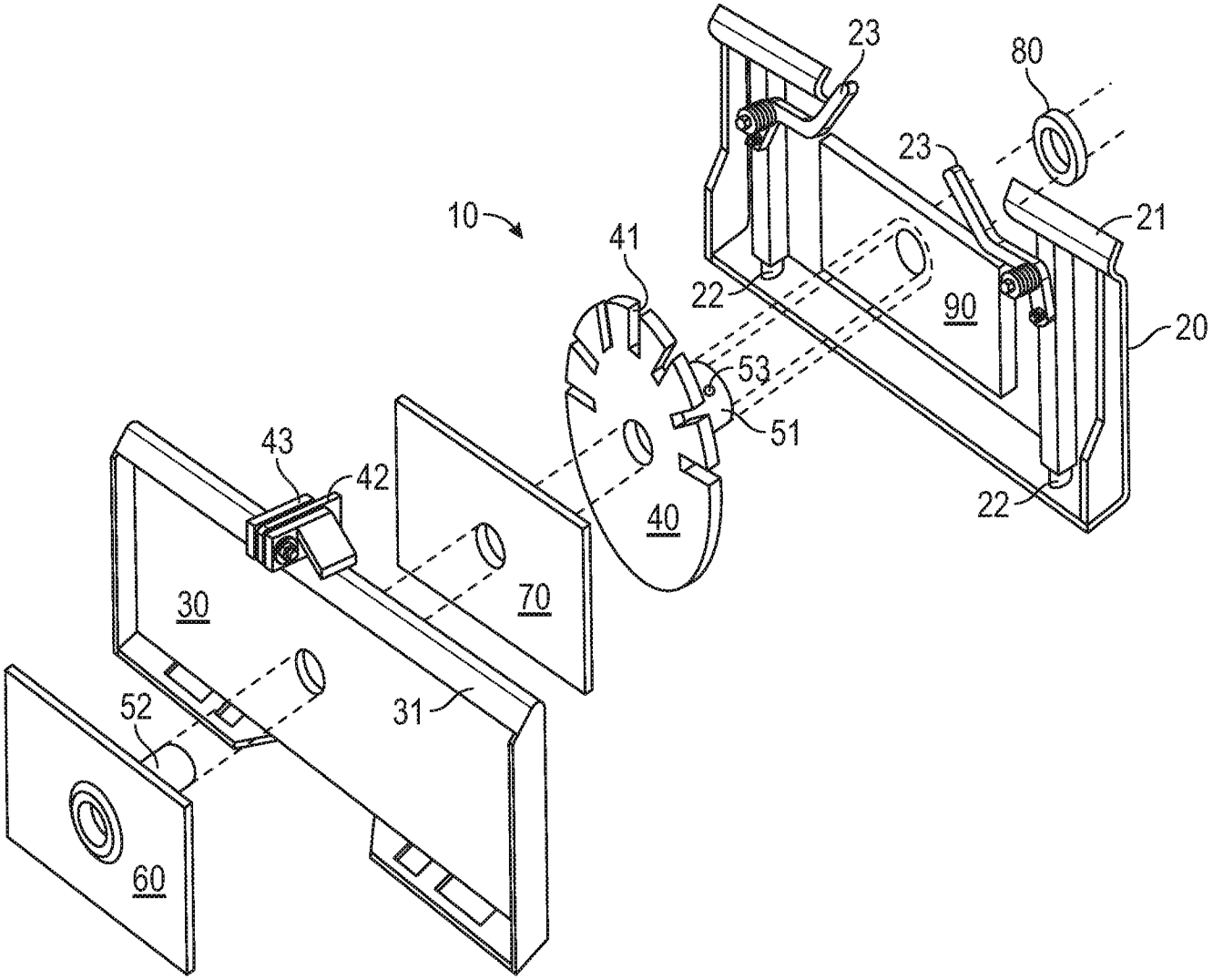
FIG. 5 is an exploded view showing alignment and connectivity of the device subparts.
Figure 6:
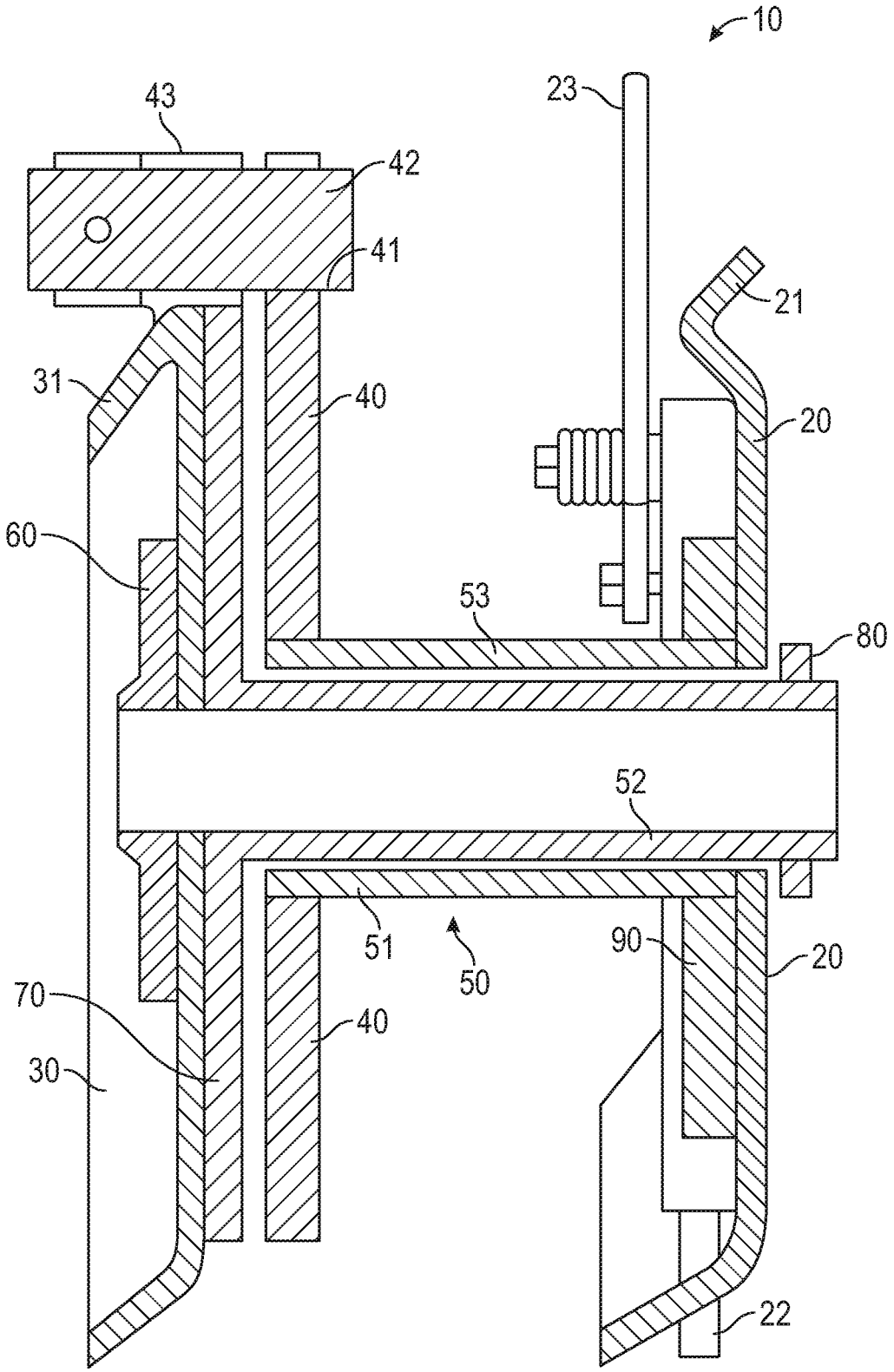
FIG. 6 is a cutaway drawing of the device on a vertical plane along a centerline of the inner barrel.

The inner barrel 52 is fitted to a commercial quick attach mounting plate 30 machined to precisely accept the outside diameter of the inner barrel 52. The mounting plate 30 is rigidly affixed to the aft end of the inner barrel 52. Aft is a position closer to the skid steer. The outer barrel 51 is fitted to a commercial quick attach conversion adapter tool work plate 20 that has been modified to provide a reinforcing steel plate 90 with a machined area to allow penetration of the outer barrel 51. Additionally, the outer barrel 51 has a notch plate 40 affixed at an aft end of the outer barrel 51 as illustrated in FIG. 5.

The notch plate 40 is a round metal plate with a machined area to allow the outer barrel 51 to penetrate in the center of the notch plate 40. The notch plate 40 is permanently affixed to the aft end of the outer barrel 51.

The mounting plate 30 that is permanently affixed to the inner barrel 52 at the aft end of the inner barrel 52, acts as a mounting surface for skid steer loader arms. The quick attach conversion adapter tool work plate 20, permanently affixed to the outer barrel 51, functions to accept a variety of commercial skid steer attachment work tools, such as grapples. A notch plate 40 is permanently affixed to the outer barrel 51 at an end opposite the tool work plate 20.

A notch plate 40 provides control over rotation of the outer barrel 51 around the inner barrel 52. The notch plate 40 has apertures in the form of notches 41 at positions around the circumferential edge of the notch plate 40. The notches 41 are all cut to a depth the same distance from an axis running along a centerline of the inner barrel 52. The notches 41 are machined to a width to accept a locking latch 42.

The swivelable adapter device 10 is fabricated such that the outer barrel 51 rotates around the inner barrel 52 while sliding on a film of grease existing between the outer wall of the inner barrel 52 and the inner wall of the outer barrel 51. A grease fitting 53 as illustrated in FIG. 5 is provided for application of grease between the inner barrel 52 and the outer barrel 51.

Both the mounting plate 30 and the tool work plate 20 have industry-standard lipped holding edges 31, 21, respectively, for attachment purposes, as shown in FIG. 5. The mounting plate lip 31 is formed on the upper edge of the mounting plate 30. This mounting plate lip 31 accepts the arms of a skid steer loader. The work plate lip 21 is formed on the upper edge of the tool work plate 20. The tool work plate lip 21 accepts various work tool attachments.

The tool work plate 20 is fitted with work plate alignment pins 22 to fit an attached work tool snugly to the tool work plate 20. A work plate alignment latch arm 23 is provided to position the work plate alignment pin 22 into the alignment area of an attached work tool.

The mounting plate 30 is snugly attached to the skid steer lifting arms using alignment pins 22 and latching arms provided on the skid steer loader. The swivelable adapter device 10 mounting plate 30 includes alignment areas to receive the skid steer loader alignment pins. With the swivelable adapter device 10 mounted on a skid steer loader using the mounting plate 30, the mounting plate 30 is fixed in position with the skid steer loader lifting arms.

Reinforcing plates 60, 70, 90 are provided to account for forces imparted by the swivelable adapter device 10 carrying heavy loads, such as a large, fallen tree. The mounting plate 30 has two reinforcing plates 60, 70 permanently affixed to the mounting plate 30. A forward reinforcing plate 70 and an aft reinforcing plate 60 prevent deformation of the mounting plate 30 during operation and use of the swivelable adapter device 10. Reinforcing work plate 90 prevents deformation of the tool work plate 20 during operation and use of the swivelable adapter device 10. The barrel within a barrel assembly 50, utilizing close tolerances, provides structural strength to lift large loads without deformation of the swivelable adapter device 10.

A locking latch 42 is the means to lock the swivelable adapter device 10 at various chosen pivotal attitudes. The locking latch 42 is affixed on the upper surface mounting plate lip 31 in a position that is above a centerline that runs through the inner barrel 52. The locking latch 42 is supported to allow positioning of the locking latch 42 in a locking latch notch 41 in the notch plate 40 when manual movement accomplishes rotation of the tool work plate 20 to a desired angle. A locking latch support mount 43 is permanently affixed to the top edge of the mounting plate lip 31 and in the center of the mounting plate 30 so the locking latch 42 is inline with the centerline of an axis running longitudinally with the inner barrel 52.

The locking latch support mount 43 holds the locking latch 42 and allows the locking latch 42 to pivot up or down. The locking latch 42 is pivoted up to release from the notch plate 40 so the notch plate 40 is free to turn by hand. Lowering the locking latch 42 allows the locking latch 42 to occupy a locking latch notch 41 for a locking latch 42 thereby creating a lock to prevent movement of the tool work plate 20 affixed to the forward end of the outer barrel 51. When the locking latch 42 is swung into a notched position, the tool work plate 20 is fixed in position with respect to the skid steer mounting plate 30 thereby affixing the mounting plate 30 in position with regard to the skid steer. The tool work plate 20 may now rotate in a range from horizontal to vertical, either in a direction to the left or to the right (opposite rotational directions), to orient a work tool implement.

The tool work plate 20 can be rotated or swiveled about an axis that is the longitudinal centerline of the inner barrel 52. Rotating the outer barrel 51 about the inner barrel 52 permits swiveling of the attached work tool because the tool work plate 20 moves with the outer barrel 51. A grease film between the inner barrel 52 and the outer barrel 51 provides a low coefficient of friction. When the swivelable adapter device 10 is mounted to a skid steer loader and loaded with a work tool on the tool work plate 20, the outer barrel 51 can be rotated using hand force. Hand rotation capability precludes the need for hydraulic systems to cause rotation of the work tool plate 20.

The position of a work tool can be easily changed by unlatching the locking latch 42, rotating the forward work tool plate 20, and re-latching the locking latch 42 in a different locking latch notch 41 position. The position locking capability provides for a whole set of different angles, from horizontal to vertical, with which to position the work tool plate 20, and therefore different angles to position a work tool/implement. See FIG. 4 for an exemplary work tool 33 that is illustrated.

Figure 7:
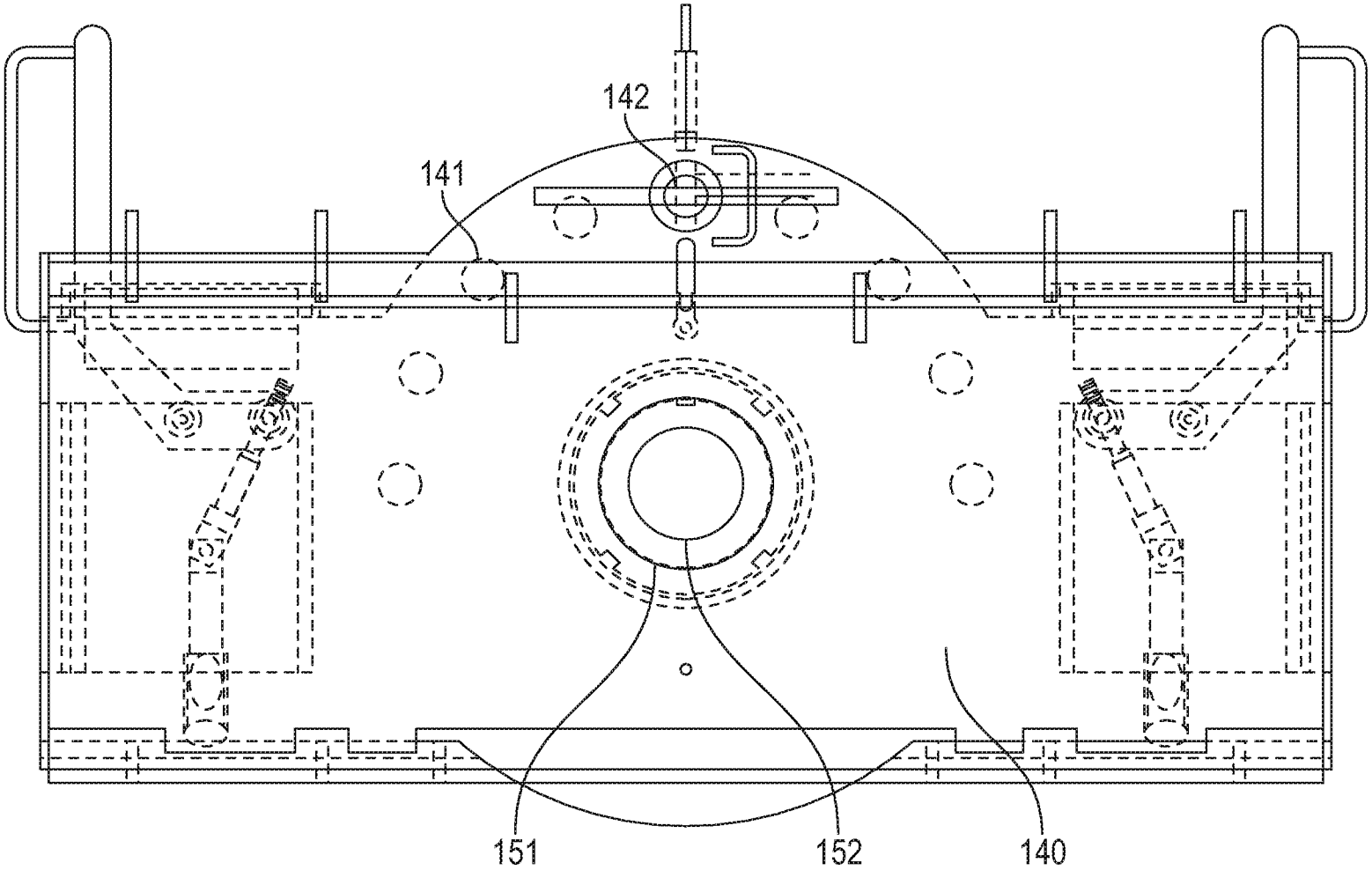
FIG. 7 illustrates a front view of a second exemplary embodiment of a notch plate implementing holes as the notch components.

Referring now to FIG. 7, this figure illustrates a front view of another exemplary embodiment of a notch plate 140. According to this exemplary embodiment, notches 41 of the prior notch plate 40 have been replaced with apertures in the form of holes 141, and latch 42 has been replaced with locking pin 142. Notch plate 140 of FIG. 7, like notch plate 40 of FIGS. 1-6, also forms an outer barrel 151 that fits over inner barrel 152. However, inner barrel 152 of FIG. 7, unlike inner barrel 52 of FIGS. 1-6, is formed by mounting plate 130 (not visible in FIG. 7, but see FIG. 8).

Figure 8:
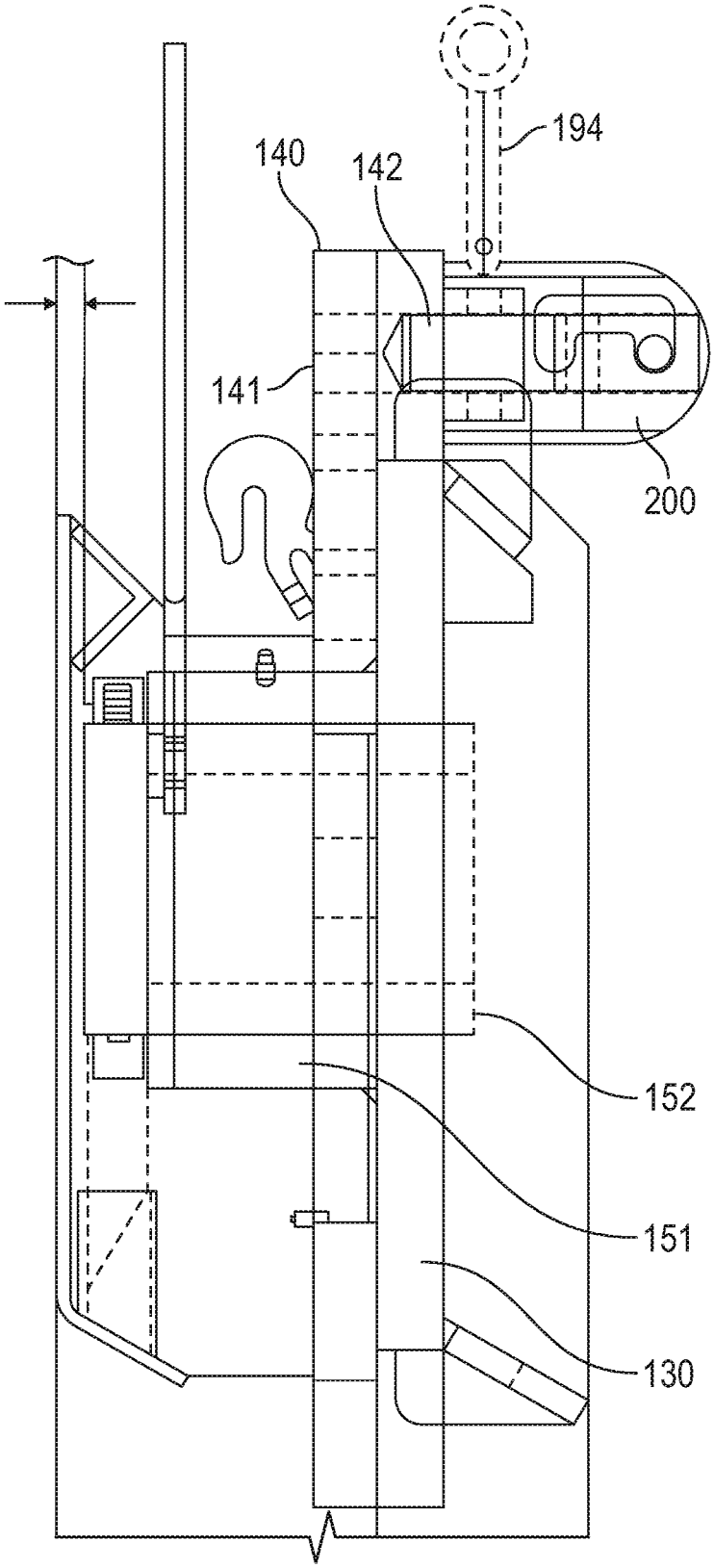
FIG. 8 illustrates a side view of the embodiment illustrated in FIG. 7.

Referring now to FIG. 8, this figure illustrates a side view of the exemplary embodiment illustrated in FIG. 7. As noted previously, latch 42 of FIGS. 1-6 has been replaced by locking pin 142, which engages holes 141. Holes 141 of FIGS. 7-8 have replaced notches 41 of FIGS. 1-6.

FIG. 8 further illustrates a safety device 194 that engages locking pin 142. Safety device 194 may comprise a bolt for coupling to locking pin 142 as will be described in more detail below. Locking pin 142 may be designed to penetrate a holding device 200, which may comprise a cylinder 200 that is integral with and/or made part of mounting plate 130. Safety device 194 may engage locking pin 142 when locking pin 142 is present within the cylinder as will be described below and illustrated in some later figures.

Figure 9:
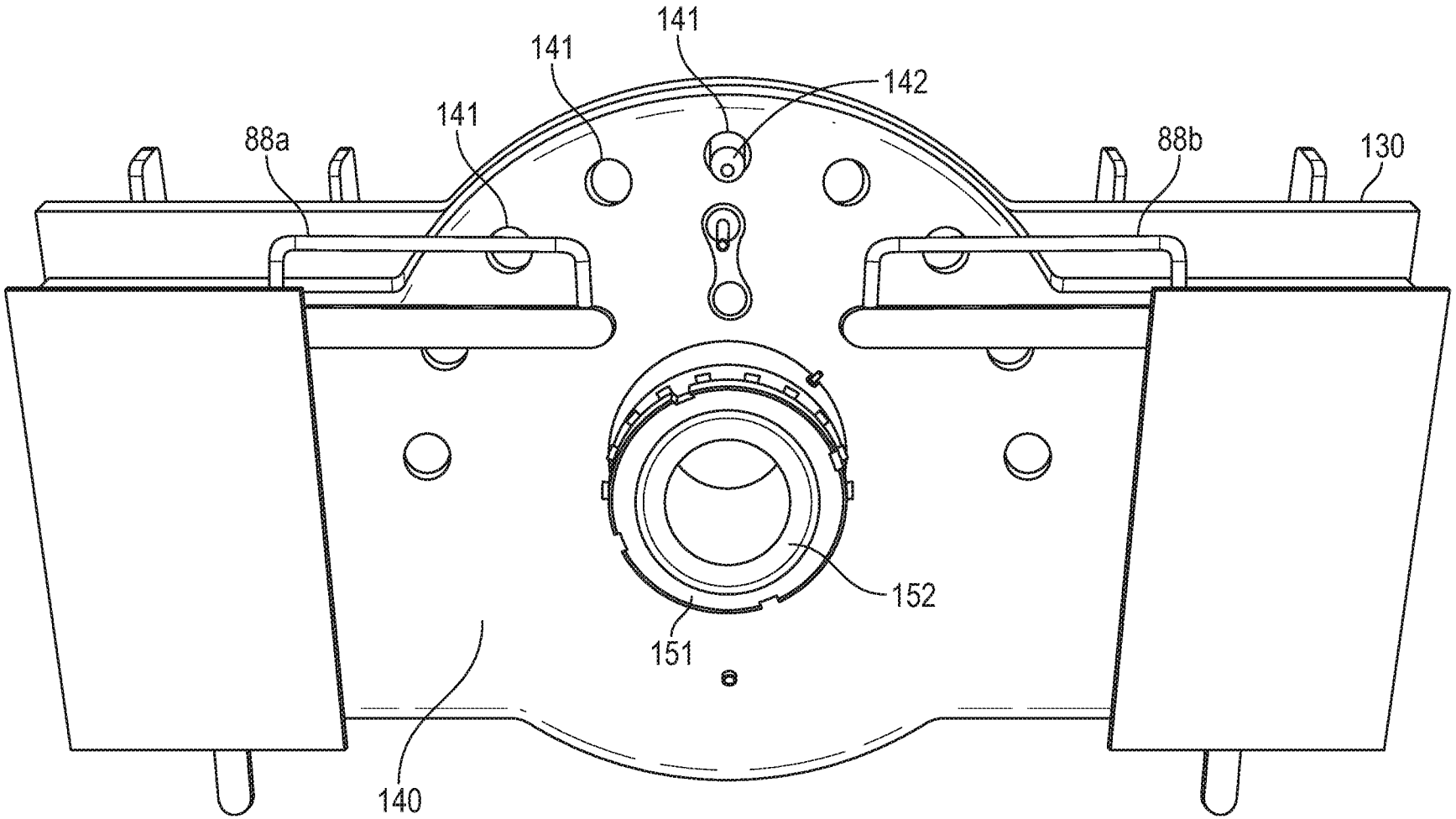
FIG. 9 illustrates another front view of the notch plate of FIG. 7 and how locking pin penetrates one of the holes within the notch plate.

Referring now to FIG. 9, this figure illustrates another front view of notch plate 140 and how locking pin 142 penetrates one of holes 141 within notch plate 140 in order to lock notch plate 140 in its current position. Locking pin 142 penetrates a single hole 141 within notch plate 140 while also penetrating cylinder 200 (not visible in FIG. 9, but see FIG. 8) that is part of mounting plate 130 (not visible in FIG. 9, but see FIG. 8).

The notch plate 140 may be coupled to two handles 88*a*, 88*b*. Handles 88*a*, 88*b* allow for the manual rotation of notch plate 140 relative to mounting plate 130 when locking pin 142 is removed from cylinder 200 of mounting plate 130 as will be described in further detail below and shown in several of the figures.

Figure 4:
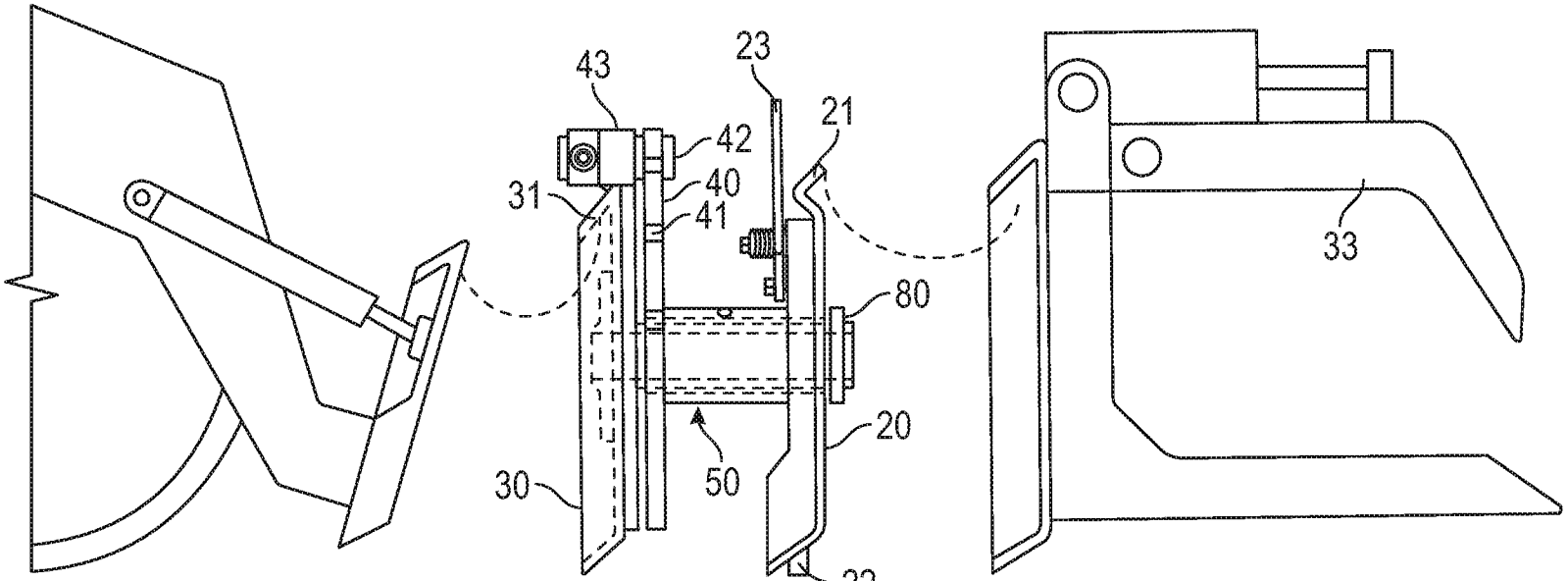
FIG. 4 illustrates the adaptive capability of the device. The device first mounts onto the skid steer. Once the mounting plate is mated to a skid steer loader, the work tool mounts to the work tool plate and is latched using a latching system.

Notch plate 140 may function as the work tool plate 20 that was illustrated in FIGS. 1-6. That is, notch plate 140 may engage and support a work tool 33, such as illustrated in FIG. 4 of the other exemplary embodiment.

Figure 10:
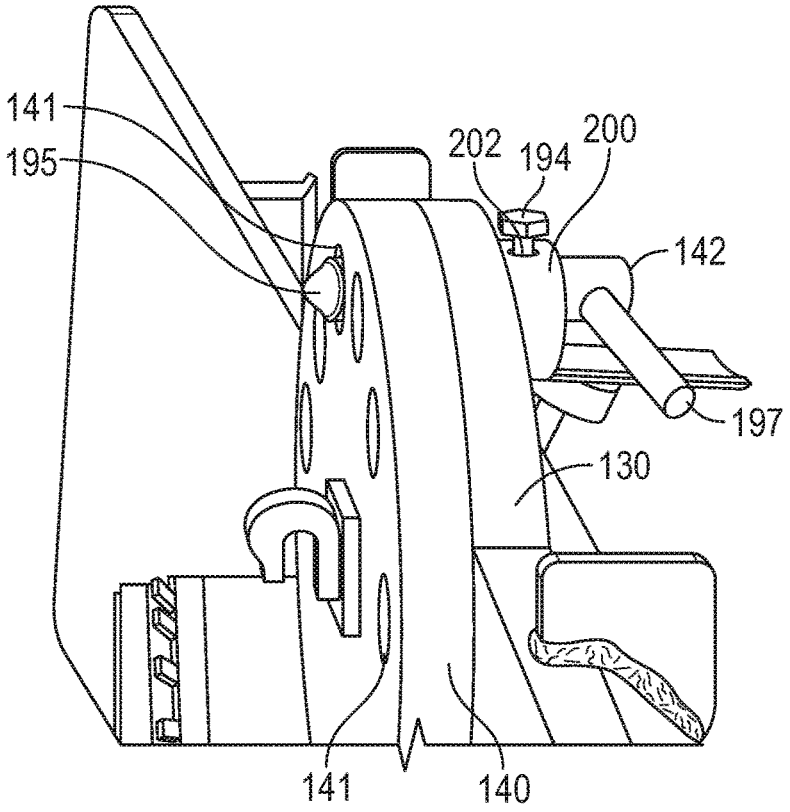
FIG. 10, figure illustrates an enlarged side view of the exemplary embodiment of FIG. 7 in which the locking pin may have one or more handles.
Figure 14:
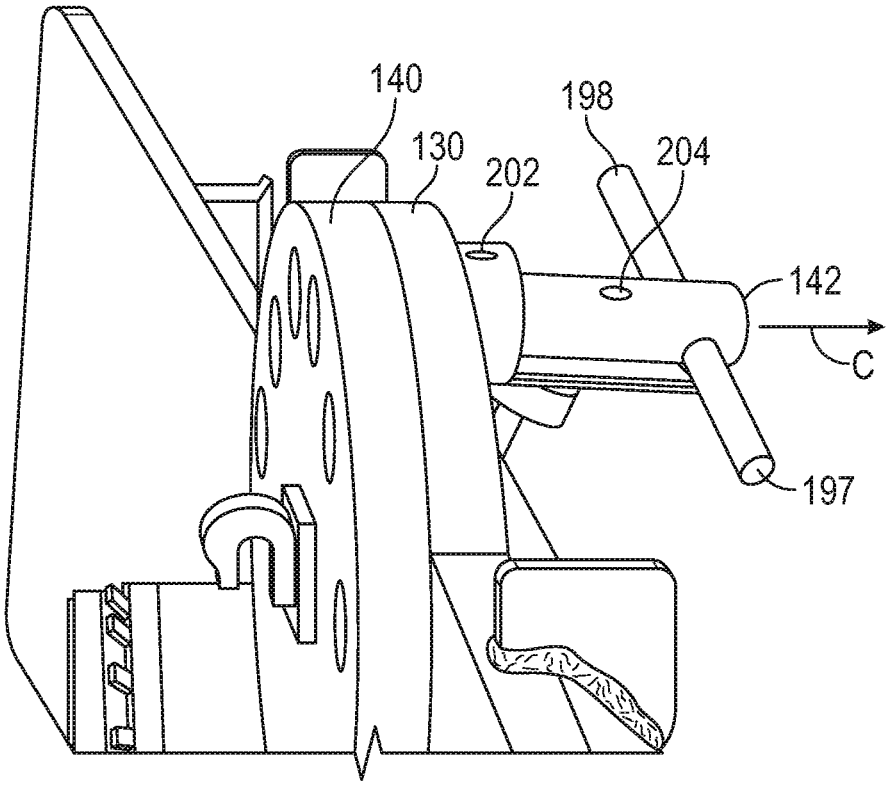
FIG. 14 illustrates movement of the locking pin from the cylinder of the mounting plate so that the locking pin is disengaged from the current hole in the notch plate.

Referring now to FIG. 10, this figure illustrates an enlarged side view of the exemplary embodiment of FIG. 7 in which locking pin 142 may have one or more handles 197, 198 (see FIG. 14 for second handle 198). Locking pin 142 may have a front portion 195 which penetrates one of holes 141 of notch plate 140. Locking pin 142 also may have a rear portion 196 that remains outside of cylinder 200 when locking pin 142 engages one of holes 141.

Safety device 194, which may comprise a bolt, penetrates through both cylinder 200 and locking pin 142 when locking pin 142 is positioned within cylinder 200 of mounting plate 130 as illustrated in FIG. 10. Cylinder 200 may comprise an aperture 202 through which safety device 194 may penetrate and engages aperture 204 (not visible in FIG. 10, but see FIG. 15) within locking pin 142. Handle 197 may be used to manipulate locking pin 142 when safety device 194 is removed from cylinder 200 as will be described below and illustrated in some later figures.

Figure 11:
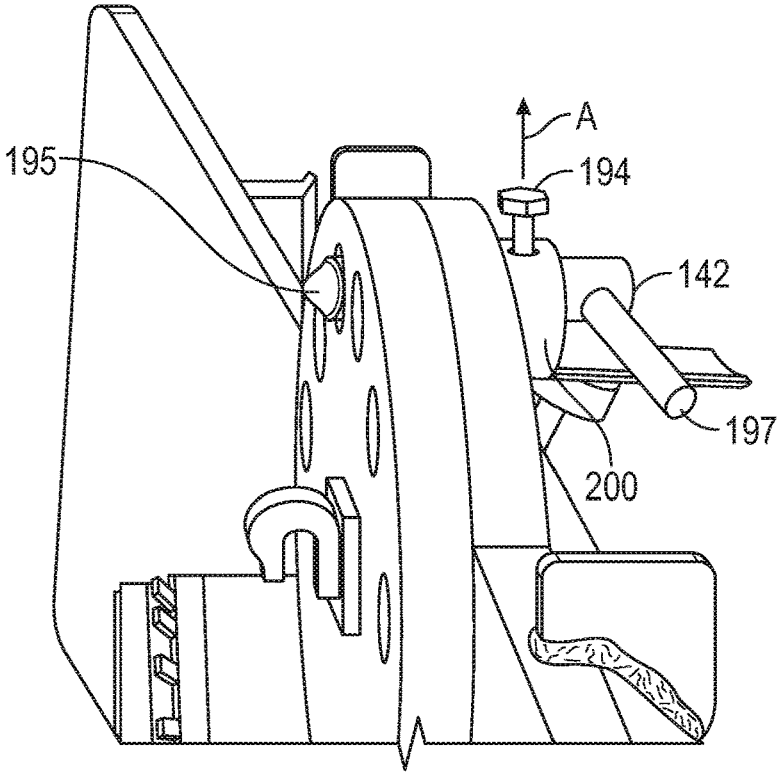
FIG. 11 illustrates another enlarged side view of the mounting plate and notch plate of FIG. 7 and how the safety device may be removed prior to locking pin being disengaged from the current hole in the notch plate.

Referring now to FIG. 11, this figure illustrates another enlarged side view of mounting plate 130 and notch plate 140 and how safety device 194 may be removed prior to locking pin 142 being disengaged from the current hole 141 in notch plate 140. As illustrated with directional arrow A, which is generally in a normal direction relative to the axis of locking pin 142, safety device 194 may be removed from cylinder 200 when it is moved in the direction of directional arrow A. In this figure, directional arrow A is generally vertical relative to the ground.

Figure 12:
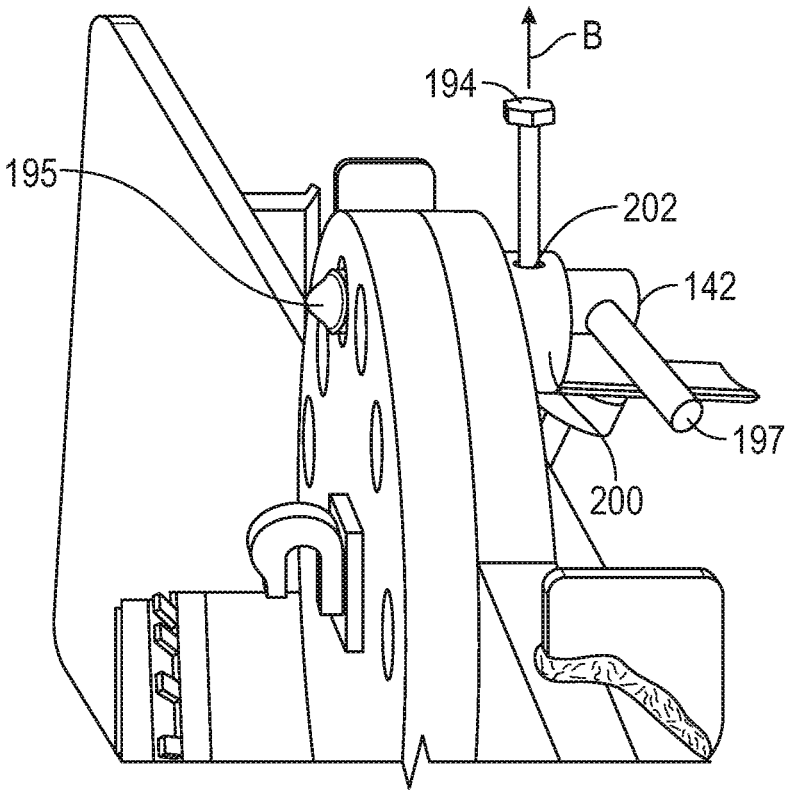
FIG. 12 is similar to FIG. 11, but shows further removal of the safety device from the cylinder of the mounting plate.

Referring now to FIG. 12, this figure is similar to FIG. 11, but shows further removal of safety device 194 from cylinder 200 of mounting plate 130. In FIG. 12, safety device 194 has been further removed from (translated upwardly relative to) cylinder 200 of mounting plate 130 along directional arrow B, which is generally in the vertical direction relative to the ground in this figure, similar or identical to the directional arrow A of FIG. 11.

Figure 13:
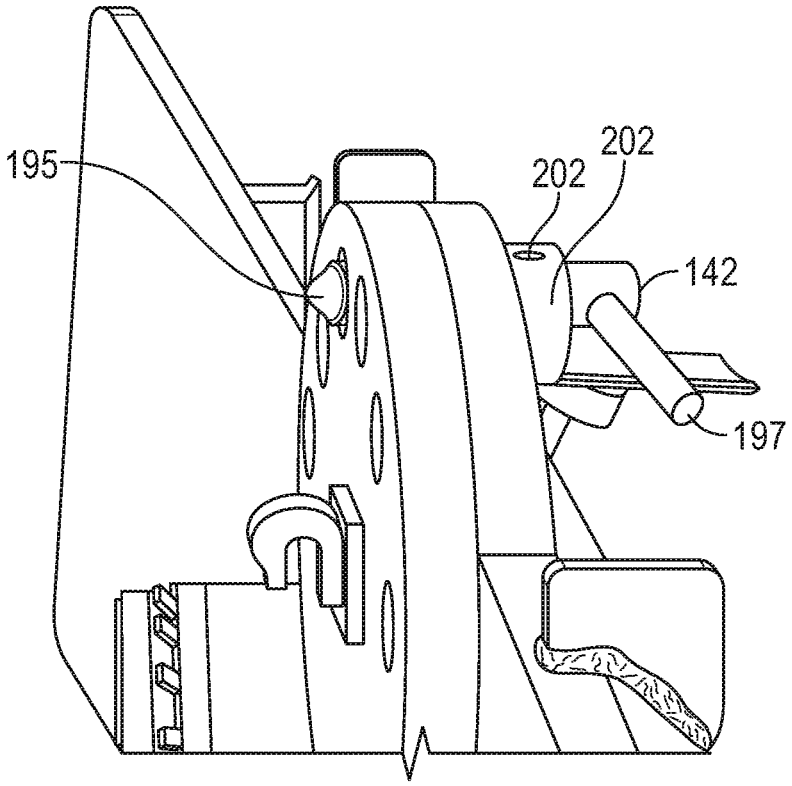
FIG. 13 illustrates the safety device fully/completely removed from the cylinder of the mounting plate so that the locking pin may be adjusted and/or removed.

Referring now to FIG. 13, this figure illustrates safety device 194 fully/completely removed from cylinder 200 of mounting plate 130 so that locking pin 142 may be adjusted and/or removed. With safety device 194 fully removed from aperture 202 of cylinder 200 and aperture 204 (not visible in FIG. 10, but see FIG. 15) of locking pin 142, one or both of the handles 197 of locking pin 142 may be grasped in order to move locking pin 142 from cylinder 200.

Referring now to FIG. 14, this figure illustrates movement of locking pin 142 from cylinder 200 so that locking pin 142 is disengaged from the current hole 141 in latch plate 140. FIG. 14 further shows the two handles 197, 198 of locking pin 142 that can be grasped by hands of an operator to remove locking pin 142 from the current hole 141 in latch plate 140 and cylinder 200 that is part of mounting plate 130. Locking pin 142 may be moved along directional arrow C, which is generally in a parallel direction relative to the axis of locking pin 142, horizontal to the ground in this figure, and is about or substantially ninety degrees relative to directional arrows A, B of FIGS. 11-12.

Figure 15:
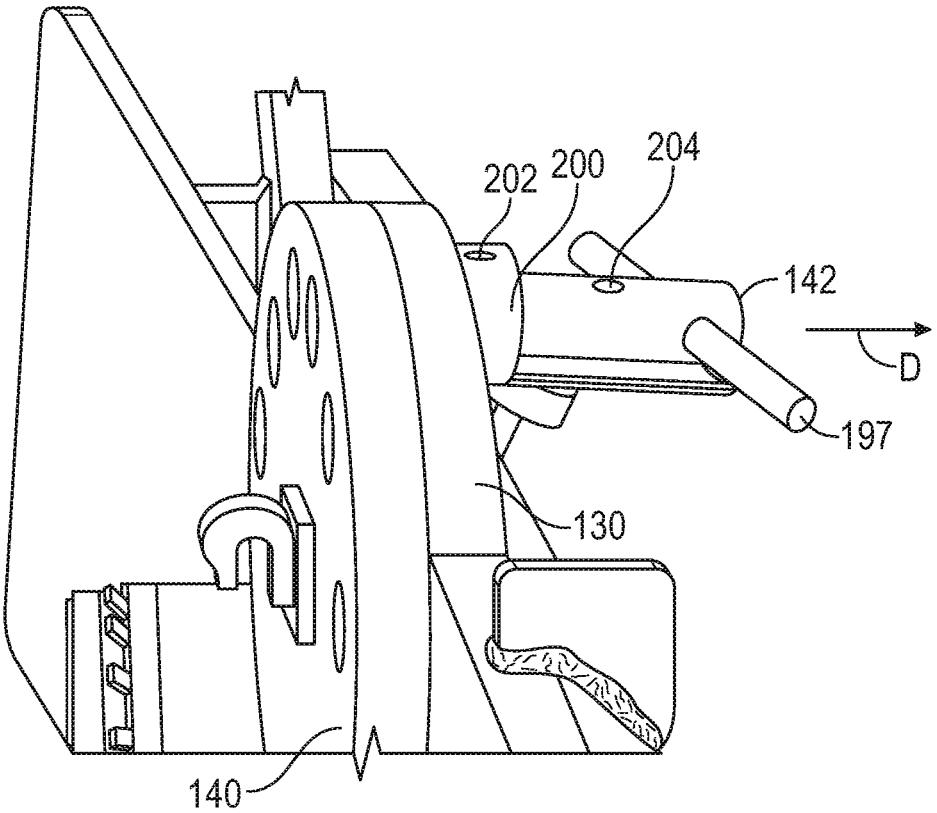
FIG. 15 illustrates further movement of the locking pin from the cylinder of the mounting plate relative to FIG. 14 so that the locking pin is disengaged from the current hole in the notch plate and so that it is almost disengaged from the cylinder of the mounting plate.

Referring now to FIG. 15, this figure illustrates further movement of locking pin 142 from cylinder 200 of mounting plate 130 relative to FIG. 14 so that locking pin 142 is disengaged from the current hole 141 in latch plate 130. In this figure, locking pin 142 has been moved further in the horizontal direction as shown by directional arrow D. At this instance, locking pin 142 is almost disengaged/separated from cylinder 200 of mounting plate 130, but not yet or completely.

Figure 16:
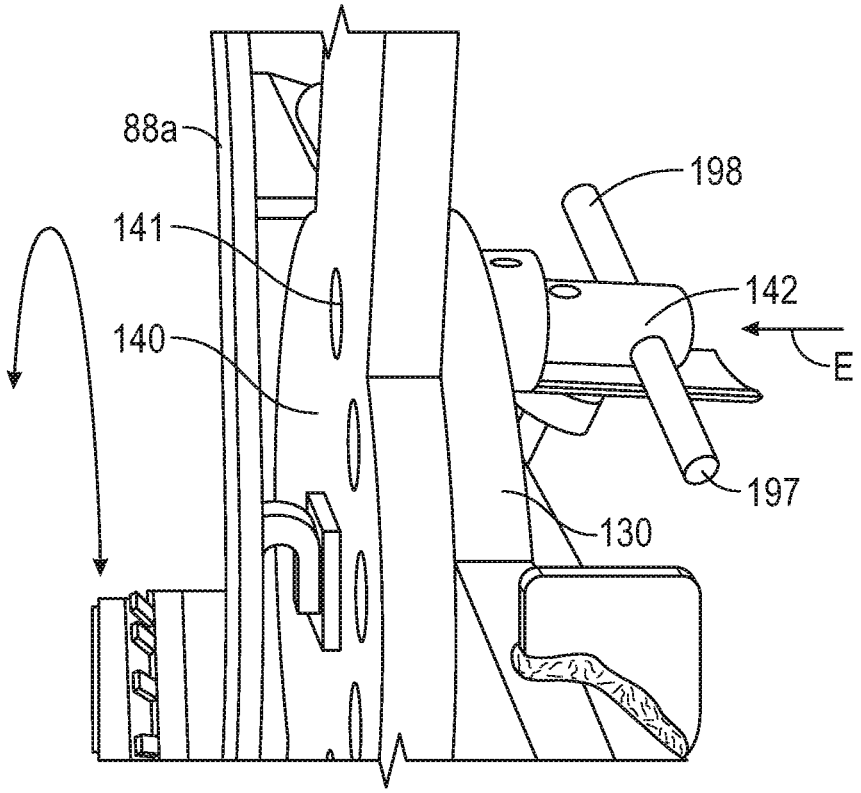
FIG. 16 illustrates the notch plate rotated by about ninety degrees relative to FIG. 15 according to an exemplary embodiment.

Referring now to FIG. 16, this figure illustrates notch plate 140 rotated by about ninety degrees relative to FIG. 15 according to an exemplary embodiment. Handle 88*a* can be used to rotate notch plate 140 into this position while locking pin 142 is inserted into cylinder 200 of mounting plate 130 as shown by directional arrow E.

Figure 17:
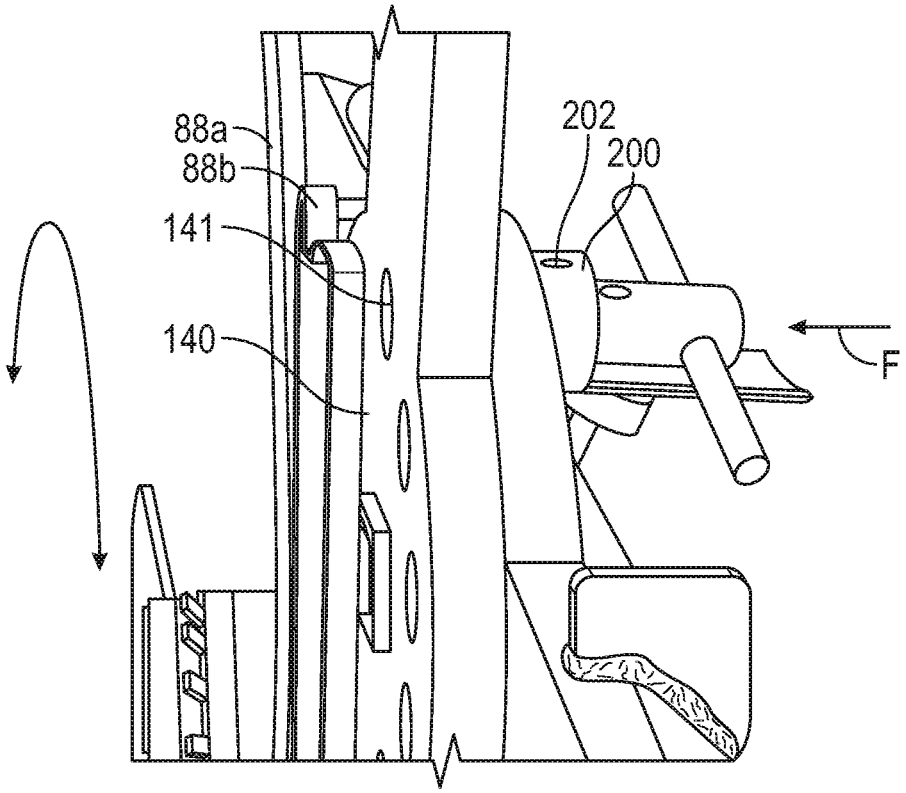
FIG. 17 illustrates the notch plate rotated by about ninety degrees as shown in FIG. 16, and the locking pin being inserted into a different locking hole on notch plate.

Referring now to FIG. 17, this figure also illustrates the notch plate rotated by about ninety degrees as shown in FIG. 16, and the locking pin being inserted into a different locking hole on notch plate. Once notch plate 140 has been rotated into this new position, locking pin 142 may be moved according to directional arrow F, which in this instance is a horizontal direction coaxial with locking pin 142 such that locking pin 142 may penetrate cylinder 200 and through a new selected hole 141 within the notch plate 140, thus locking notch plate 140 in the new position.

Figure 18:
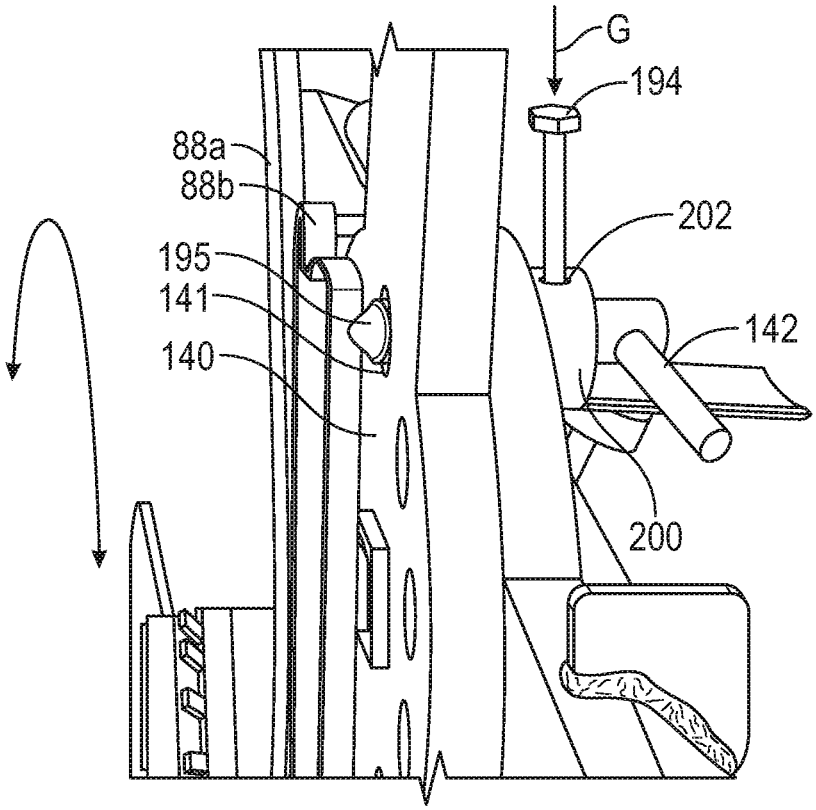
FIG. 18 illustrates the notch plate rotated by about ninety degrees as shown in FIG. 16 and being locked in place, wherein the locking pin is fully inserted into cylinder of the mounting plate such that the aperture of the locking pin aligns with the aperture of the cylinder, so that the safety device may penetrate both the aperture of the cylinder and the aperture of the locking pin.

Referring now to FIG. 18, this figure FIG. 18 illustrates the notch plate rotated by about ninety degrees as shown in FIG. 16 and being locked in place, wherein the locking pin 142 is fully inserted into cylinder 200 of mounting plate 130 such that aperture 202 of locking pin 142 aligns with aperture 204 (not visible in this figure) of cylinder 200, so that safety device 194 may penetrate both the aperture 202 of the cylinder 200 and the aperture 204 of the locking pin 142. In other words, locking pin 142 is fully inserted into cylinder 200 of mounting plate 130 such that aperture 204 (not visible in this figure) of locking pin 142 aligns with aperture 202 of cylinder 200, so that safety device 194 may penetrate both apertures 202, 204. Safety device 194, shown in the form of a bolt, may be moved according to directional arrow G, which is in this view is a vertical, downward direction relative to the earth. Safety device 194 may lock locking pin 142 in its position within a selected hole 141 of notch plate 140.

As can be seen from FIGS. 7-18, one of ordinary skill in the art would be able to rotate notch plate 140 relative to mounting plate 130 simply by disengaging (unlocking) locking pin 142 from a first hole 141 in notch plate 140, rotating notch plate 140 relative to mounting plate 130 such that a different hole 141 lines up with locking pin 142, and reinserting (locking) locking pin 142 into the new hole 141, thereby locking notch plate 140 in the new position relative to mounting plate 130. Safety device 194 is a safety feature to help prevent accidental withdrawal of locking pin 142 from hole 141.

As disclosed herein, and based on the figures, directional arrows A-F are shown and/or disclosed as being in a vertical orientation or direction or in a horizontal orientation or direction. This is for ease of disclosure. As can be appreciated by those of ordinary skill in the art, directional arrows A-F, and therefore the direction of movement represented by directional arrows A-F, can be non-vertical or non-horizontal depending on, for example, the slope on which the skid steer loader is positioned, the positioning of the skid steer arms, and the type and manufacturer of the skid steer loader.

In both embodiments shown in this disclosure, sufficient notches 41 and holes 141 are provided in notch plate 40 and notch plate 141, respectively, to allow rotation of notch plate 40, 140 approximately 180 degrees (90 degrees each rotational direction from a generally horizontal position relative to the ground) relative to mounting plate 30, 130, respectively. The total number of holes 41, 141, the placement of holes 41, 141, and the total degrees of rotation of notch plate 40, 140 relative to mounting plate 30, 130, can be determined by one of ordinary skill in the art depending on, for example, the size of the device 10, the desired use of the device 10, and the materials of manufacture of the device 10.

A skid steer loader operator can now attach a work tool implement, set an angle from horizontal to vertical, as desired, and utilize a work tool implement at that positioned angle. This angle changing capability allows, for example, the use of a skid steer loader to extricate a tree leaning at a severe angle. Such a situation occurs frequently following windstorms, like hurricanes, that blow trees down. Some trees are not blown down flat and may rest precariously at angles between horizontal and vertical. Often such trees rest against structures, carrying potential energy. The removal of a leaning tree against a structure is easily and safely accomplished utilizing the swivelable adapter device 10.

The work tool plate(s) 20, which are mounted on or a part of mounting plate 30, 310, thus can be swiveled manually by hand. No hydraulic actuation force is needed to cause rotation. This fact is significant as there are a wide variety of different skid steer loader manufacturers in the commercial market. Each manufacturer may have a unique hydraulic hose and control connection setup. The swivelable adapter device 10 is fabricated to rotate easily by hand. Because the swivelable adapter device 10 does not need hydraulics, the device can be utilized on a variety of skid steer loaders, regardless of the type of hydraulic system setup.

Work tool plate alignment latch arms 23 to operate the work tool plate alignment pins 22 are also provided on the work tool plate 20. These work tool plate alignment pins 22 and work tool plate alignment latch arm 23 are common to the field of art. The notch plate 40, 140 generally comprise a circular mass of plate metal machined to assist in balancing loads during rotation of the work tool plate 20 that is permanently affixed to the outer barrel 51.

One advantage of a skid steer loader swivelable adapter 10 that rotates is to allow a skid steer loader to be a multi-use tool for small business owners. A tree removal job that would normally takes hours can be accomplished in minutes with fewer people on the work crew. The swivelable adapter device 10 fits on multiple skid steer loaders. The tool does not need hydraulics so it is not limited to skid steer loaders with manufacturer specific hydraulic hookup features. The swivelable adapter device 10 rotates from horizontal to vertical and locks to orient a work tool 33 (See FIG. 4 for work tool 33) implement to a work load.

Although the present invention has been described in considerable detail with reference to certain preferred versions thereof, other versions are possible. Therefore, the spirit and scope of the appended claims should not be limited to the description of the preferred version contained therein. The reader's attention is directed to all papers and documents, which are filed concurrently with this specification and are open to public inspection with this specification, and the contents of all such papers and documents, are incorporated herein by reference. All features disclosed in this specification, including any accompanying claims, abstract, and drawings, may be replaced by alternative features serving the same, equivalent or similar purpose, unless expressly stated otherwise.

LIST OF REFERENCE NUMERALS

10 Swivelable adapter device
20 Work tool plate
21 Work tool plate lip
22 Work tool plate alignment tip
23. Work tool plate alignment latch am
30 Mounting plate
31 Mounting plate lip
33 Work tool

40 Notch plate
41 Locking latch notch
42 Locking latch
43 Locking latch support mount
50 Barrel within a barrel assembly
51 Outer barrel
52. Inner barrel
53 Grease fitting
60 Aft reinforcing mounting plate
70 Forward reinforcing mounting plate
80 Holding ring
88 Handles of notch plate
90 Reinforcing work tool plate
130 Mounting Plate
140 Notch plate
141 Notch plate holes
142 Locking pin
151 Outer Barrel
152 Inner Barrel
194 Safety device
195 Front portion locking pin
196 Rear portion locking pin
197 First handle locking pin
198 Second handle locking pin
200 Holding Device, cylinder
202 Aperture in holding device
204 Aperture in locking pin

What is claimed is:

1. A swivelable adapter device for a skid steer loader comprising:

a mounting plate, the mounting plate comprising a holding device and an inner barrel;

a locking mechanism positioned within the holding device, the locking mechanism comprising a locking pin and the holding device of the mounting plate comprises a cylinder for accepting the locking pin;

a work tool plate contacting the mounting plate, the work tool plate comprising a notch plate, the notch plate comprising a plurality of holes, wherein at least one of the holes receives the locking pin when the locking pin is in a locked position, and the notch plate further comprising an outer barrel that engages and envelopes the inner barrel of the mounting plate, wherein an outer barrel inside dimension is greater than an inner barrel outside dimension to allow clearance for the outer barrel to slide over the inner barrel, whereby during assembly of the swivelable adapter device the outer barrel is slid over the inner barrel, wherein the swivelable adapter device is held together such that the notch plate with its outer barrel is rotatable around the inner barrel of the mounting plate, and causing rotation of the notch plate, the hole receiving the locking pin aligns with the locking pin for receiving the locking pin, and the hole receiving the locking pin and the locking pin hold the notch plate in a position after the notch plate is rotated about the inner barrel of the mounting plate to the position.

2. The swivelable adapter device of claim 1, wherein the holding device engages with a safety device.

3. The swivelable adapter device of claim 2, wherein the safety device comprises a bolt.

4. The swivelable adapter device of claim 3, wherein the holding device comprises an aperture for receiving the bolt of the safety device.

5. The swivelable adapter device of claim 4, wherein the locking pin also comprises an aperture for receiving the safety device.

6. The swivelable adapter device of claim 1, wherein the mounting plate is coupled to at least one skid steer loader arms of the skid steer loader.

7. The swivelable adapter device of claim 1, wherein the notch plate accepts a variety of commercial skid steer attachment work tools.

8. The swivelable adapter device of claim 1, wherein when the swivelable adapter device is mounted on a skid steer loader using the mounting plate, the mounting plate is fixed in position with skid steer loader lifting arms.

9. A swivelable adapter device for a skid steer loader comprising:

a mounting plate, the mounting plate comprising a holding device and an inner barrel;

a locking mechanism positioned within the holding device, the locking mechanism engaging with a safety device, the locking mechanism comprising a locking pin and the holding device of the mounting plate comprises a cylinder for accepting the locking pin;

a work tool plate contacting the mounting plate, the work tool plate comprising a notch plate, the notch plate comprising a plurality of holes, wherein at least one of the holes receives the locking pin when the locking pin is in a locked position, and the notch plate further comprising an outer barrel that engages and envelopes the inner barrel of the mounting plate, wherein an outer barrel inside dimension is greater than an inner barrel outside dimension to allow clearance for the outer barrel to slide over the inner barrel, whereby during assembly of the swivelable adapter device the outer barrel is slid over the inner barrel, wherein the swivelable adapter device is held together such that the notch plate with its outer barrel is rotatable around the inner barrel of the mounting plate, and causing rotation of the notch plate, the hole receiving the locking pin aligns with the locking pin for receiving the locking pin, and the hole receiving the locking pin and the locking pin holding the notch plate in a position after the notch plate is rotated about the inner barrel of the mounting plate to the position.

10. The swivelable adapter device of claim 9, wherein the holding device engages with the safety device.

11. The swivelable adapter device of claim 10, wherein the safety device comprises a bolt.

12. The swivelable adapter device of claim 11, wherein the holding device comprises an aperture for receiving the bolt of the safety device.

13. A swivelable adapter device for a skid steer loader comprising:

a mounting plate, the mounting plate comprising a holding device and an inner barrel;

a locking mechanism positioned within the holding device, the locking mechanism comprising a locking pin and the holding device of the mounting plate comprises a cylinder for accepting the locking pin; and a work tool plate affixed to an outer barrel, the work tool plate comprising a notch plate, the notch plate comprising a plurality of holes, wherein at least one of the holes receives the locking pin when the locking pin is in a locked position, and the notch plate further comprising an outer barrel that engages and envelopes the inner barrel of the mounting plate, wherein an outer barrel inside dimension is greater than an inner barrel outside dimension to allow clearance for the outer barrel to slide over the inner barrel, wherein the work tool plate is affixed to the outer barrel, the outer barrel is slid over the inner barrel during assembly, wherein the swivelable adapter device is held together such the outer barrel is rotatable around the inner barrel, causing rotation of the work tool plate and the notch plate relative to the mounting plate, with the locking mechanism holding the work tool plate in various positions after the work tool plate is rotated.

14. The swivelable adapter device of claim 13, wherein the mounting plate is machined to accept the inner barrel outside diameter and wherein the mounting plate is rigidly affixed near an end of the inner barrel.

15. The swivelable adapter device of claim 13, wherein the work tool plate is machined to allow passage of the inner barrel through the work tool plate so as to establish a clearance between the inner barrel and the work tool plate.

16. The swivelable adapter device of claim 13, wherein the outer barrel is joined to the work tool plate at a forward end of the outer barrel and at an aft side of the work tool plate.

17. The swivelable adapter device of claim 13, wherein the mounting plate that is affixed to the inner barrel near an aft end of the inner barrel, acts as a mount surface for skid steer loader arms of the skid steer loader.

18. The swivelable adapter device of claim 13, wherein the work tool plate is affixed to the outer barrel and therein functions to accept skid steer attachment work tools.

19. The swivelable adapter device of claim 13, wherein when the swivelable adapter device is mounted on a skid steer loader using the mounting plate, such that the mounting plate is fixed in position with skid steer loader lifting arms.

* * * * *